US005935512A

United States Patent [19]

Haynes et al.

[11] Patent Number: 5,935,512

[45] Date of Patent: Aug. 10, 1999

[54] NONWOVEN PROCESS AND APPARATUS

[75] Inventors: Bryan David Haynes, Cumming; Kevin James Kastner, Clarkesville; Jark Chong Lau, Roswell; Samuel Edward Marmon, Alpharetta; Charles John Morell, Roswell; Stephen Harding Primm, Cumming, all of Ga.; Thomas Gregory Triebes, Tucson, Ariz.

[73] Assignee: Kimberly-Clark Worldwide, Inc., Neenah, Wis.

[21] Appl. No.: 08/993,470

[22] Filed: Dec. 18, 1997

Related U.S. Application Data

[60] Provisional application No. 60/034,392, Dec. 30, 1996.

[51] Int. Cl.[6] ..... D01D 5/092; D01D 5/14

[52] U.S. Cl. ..... 264/555; 264/103; 264/210.8; 264/211.14; 425/66; 425/72.2; 425/378.2; 425/382.2; 425/464

[58] Field of Search ..... 264/103, 210.8, 264/211.14, 555; 425/66, 72.2, 378.2, 382.2, 464

[56] References Cited

U.S. PATENT DOCUMENTS

| | | | |
|---|---|---|---|
| 1,933,587 | 11/1933 | Dreyfus et al. | 18/8 |
| 2,131,810 | 10/1938 | Kinsella et al. | 18/8 |
| 3,257,487 | 6/1966 | Dulin, Jr. | 264/176 |
| 3,338,992 | 8/1967 | Kinney | 264/24 |
| 3,341,394 | 9/1967 | Kinney | 161/72 |
| 3,379,811 | 4/1968 | Hartmann et al. | 264/210 |
| 3,502,538 | 3/1970 | Petersen | 161/150 |
| 3,502,763 | 3/1970 | Hartmann | 264/210 |
| 3,528,129 | 9/1970 | Hartmann | 18/8 |
| 3,542,615 | 11/1970 | Dobo et al. | 156/181 |
| 3,618,167 | 11/1971 | Brassard et al. | 18/855 |
| 3,692,618 | 9/1972 | Dorschner et al. | 161/72 |
| 3,737,508 | 6/1973 | Weir | 264/204 |
| 3,761,559 | 9/1973 | Heckrotte et al. | 264/237 |
| 3,802,817 | 4/1974 | Matsuki et al. | 425/66 |
| 3,814,559 | 6/1974 | Akers, II et al. | 425/72 |
| 3,847,522 | 11/1974 | Heckrotte et al. | 425/72 |
| 3,855,046 | 12/1974 | Hansen et al. | 161/150 |
| 3,881,850 | 5/1975 | Stockbridge | 425/72 |
| 3,932,081 | 1/1976 | Buchmann et al. | 425/72 |

(List continued on next page.)

FOREIGN PATENT DOCUMENTS

| | | |
|---|---|---|
| 0285736 | 10/1988 | European Pat. Off. . |
| 39 29 961 | 1/1991 | Germany . |
| 7137773 | 10/1963 | Japan . |
| 579354 | 11/1977 | U.S.S.R. . |
| 1656-016 | 6/1991 | U.S.S.R. . |
| 745098 | 2/1956 | United Kingdom . |
| 89/03903 | 5/1989 | WIPO . |

OTHER PUBLICATIONS

*Polymer Blends and Composites*, John A. Manson and Leslie H. Sperling, copyright 1976, Plenum Press, ISBN–0–306–30831–2, pp. 273–277.

*Primary Examiner*—Leo B. Tentoni
*Attorney, Agent, or Firm*—William D. Herrick

[57] ABSTRACT

Improved equipment and method for spinning filaments for nonwovens using an integral spinbank including one or more spinplates producing filament bundles separated by one or more central conduits for quench air. Embodiments include high velocity quench air driven into the central conduit or quench air blown or drawn in from outside the filaments into the central conduit. Means may also be provided for removal of undesired waxes and/or other condensates through a central exhaust removal using the central conduit. As quench air velocity is increased through the central conduit, the streams tend to improve total quench flow by deflecting opposing flows into a uniform stream. Other variations include division of quench air into flow zones that may be independently controlled and varying the angle of quench air flow and/or the spinplates to maintain separation distance between quench air and filament bundles.

19 Claims, 7 Drawing Sheets

U.S. PATENT DOCUMENTS

| | | | |
|---|---|---|---|
| 3,969,462 | 7/1976 | Stofan | 264/237 |
| 4,022,558 | 5/1977 | Herrington | 425/72 |
| 4,041,203 | 8/1977 | Brock et al. | 428/157 |
| 4,123,208 | 10/1978 | Klaver et al. | 425/72 |
| 4,124,666 | 11/1978 | Wilhelm et al. | 264/39 |
| 4,168,138 | 9/1979 | McNally | 425/66 |
| 4,259,048 | 3/1981 | Miani | 425/72 |
| 4,283,364 | 8/1981 | Capps et al. | 264/176 |
| 4,285,646 | 8/1981 | Waite | 425/72 |
| 4,288,207 | 9/1981 | Wilkes | 425/72 |
| 4,332,764 | 6/1982 | Brayford et al. | 264/176 |
| 4,340,563 | 7/1982 | Appel et al. | 264/518 |
| 4,341,726 | 7/1982 | Wilkes | 264/130 |
| 4,362,682 | 12/1982 | Berg et al. | 264/143 |
| 4,374,888 | 2/1983 | Bornslaeger | 428/198 |
| 4,378,325 | 3/1983 | Waite | 264/176 |
| 4,383,817 | 5/1983 | Mirhej | 425/463 |
| 4,402,900 | 9/1983 | Berry, Jr. | 264/205 |
| 4,505,867 | 3/1985 | Mirhej | 264/103 |
| 4,626,397 | 12/1986 | Bose | 264/565 |
| 4,756,679 | 7/1988 | Stibal et al. | 425/72 |
| 4,804,511 | 2/1989 | Pieper et al. | 264/206 |
| 4,818,463 | 4/1989 | Buehning | 264/40.1 |
| 4,826,415 | 5/1989 | Mende | 425/722 |
| 4,851,179 | 7/1989 | Reifenhauser | 264/555 |
| 4,988,270 | 1/1991 | Stibal et al. | 425/72.2 |
| 4,990,297 | 2/1991 | Stibal et al. | 264/211.14 |
| 4,997,611 | 3/1991 | Hartmann | 264/210.8 |
| 5,028,375 | 7/1991 | Reifenhauser | 264/518 |
| 5,059,104 | 10/1991 | Alberto | 425/72.2 |
| 5,088,913 | 2/1992 | Chambers | 425/182 |
| 5,108,276 | 4/1992 | Hartmann | 425/66 |
| 5,108,820 | 4/1992 | Kaneko et al. | 428/198 |
| 5,108,827 | 4/1992 | Gessner | 428/219 |
| 5,122,321 | 6/1992 | Chambers | 264/169 |
| 5,165,940 | 11/1992 | Windley | 425/72.2 |
| 5,169,706 | 12/1992 | Collier, IV et al. | 428/152 |
| 5,178,814 | 1/1993 | Lemond | 264/211.15 |
| 5,178,931 | 1/1993 | Perkins et al. | 428/198 |
| 5,219,585 | 6/1993 | Shealy et al. | 425/182 |
| 5,230,905 | 7/1993 | Fare et al. | 425/72.2 |
| 5,336,552 | 8/1994 | Strack et al. | 428/224 |
| 5,370,833 | 12/1994 | Wellenhofer et al. | 264/101 |
| 5,382,400 | 1/1995 | Pike et al. | 264/168 |
| 5,476,616 | 12/1995 | Schwarz | 264/6 |
| 5,536,157 | 7/1996 | Linz | 425/72.2 |
| 5,733,586 | 3/1998 | Herwegh et al. | 425/192 S |

NONWOVEN PROCESS AND APPARATUS

This application claims priority from U.S. Provisional Application No. 60/034,392 filed Dec. 30, 1996.

BACKGROUND OF THE INVENTION

Nonwoven fabrics and their manufacture have been the subject of extensive development resulting in a wide variety of materials for numerous applications. For example, nonwovens of light basis weight and open structure are used in personal care items such as disposable diapers as liner fabrics that provide dry skin contact but readily transmit fluids to more absorbent materials which may also be nonwovens of a different composition and/or structure. Nonwovens of heavier weights may be designed with pore structures making them suitable for filtration, absorbent and barrier applications such as wrappers for items to be sterilized, wipers or protective garments for medical, veterinary or industrial uses. Even heavier weight nonwovens have been developed for recreational, agricultural and construction uses. These are but a few of the practically limitless examples of types of nonwovens and their uses that will be known to those skilled in the art who will also recognize that new nonwovens and uses are constantly being identified. There have also been developed different ways and equipment to make nonwovens having desired structures and compositions suitable for these uses. Examples of such processes include spunbonding, meltblowing, carding, and others which will be described in greater detail below. The present invention has general applicability to equipment and processes generally of the spunbond type as will be apparent to one skilled in the art.

Spunbond processes generally require large amounts of a fluid such as air that is used for quenching the molten filaments and for drawing and attenuating the filaments for increased strength. This fluid not only represents a cost, but it must be carefully controlled to avoid deleterious effects on the filaments and the resulting nonwoven web. While many advancements have been made in spunbonding processes and equipment, improved web uniformity, strength, tactile and appearance properties with higher efficiency remain sought-after goals.

SUMMARY OF THE INVENTION

The present invention is directed to improved processes and apparatus for forming spunbond nonwovens. The process and apparatus combine multiple spinplates into a single bank or divide a spinplate into multiple components with a central fluid conduit. The capacity of multiple banks is obtained with more efficient and effective use of fluid (usually air) for quenching and drawing and better control of the fluid resulting in improved web properties. In various embodiments the central conduit may be used to blow quench fluid or may exhaust fluid that is applied from opposing sides of the filament curtain or bundle. In all cases, the combined spinplates operate with higher efficiency and better control of fiber and web properties. In advantageous embodiments the spinplates may be placed at an angle with respect to vertical and to each other and augment the natural convection flow. Also, the fluid velocity in the central conduit may be selected so as to provide improved performance. The results include accelerating quench and reduction of turbulence effects which widen the range of operating conditions and permit increased productivity as well as the ability to operate at very high numbers of spinneret holes producing finer fibers at high production rates. Another advantage is more uniform quench through the bundle.

DETAILED DESCRIPTION OF THE INVENTION

Definitions

Figure 1:
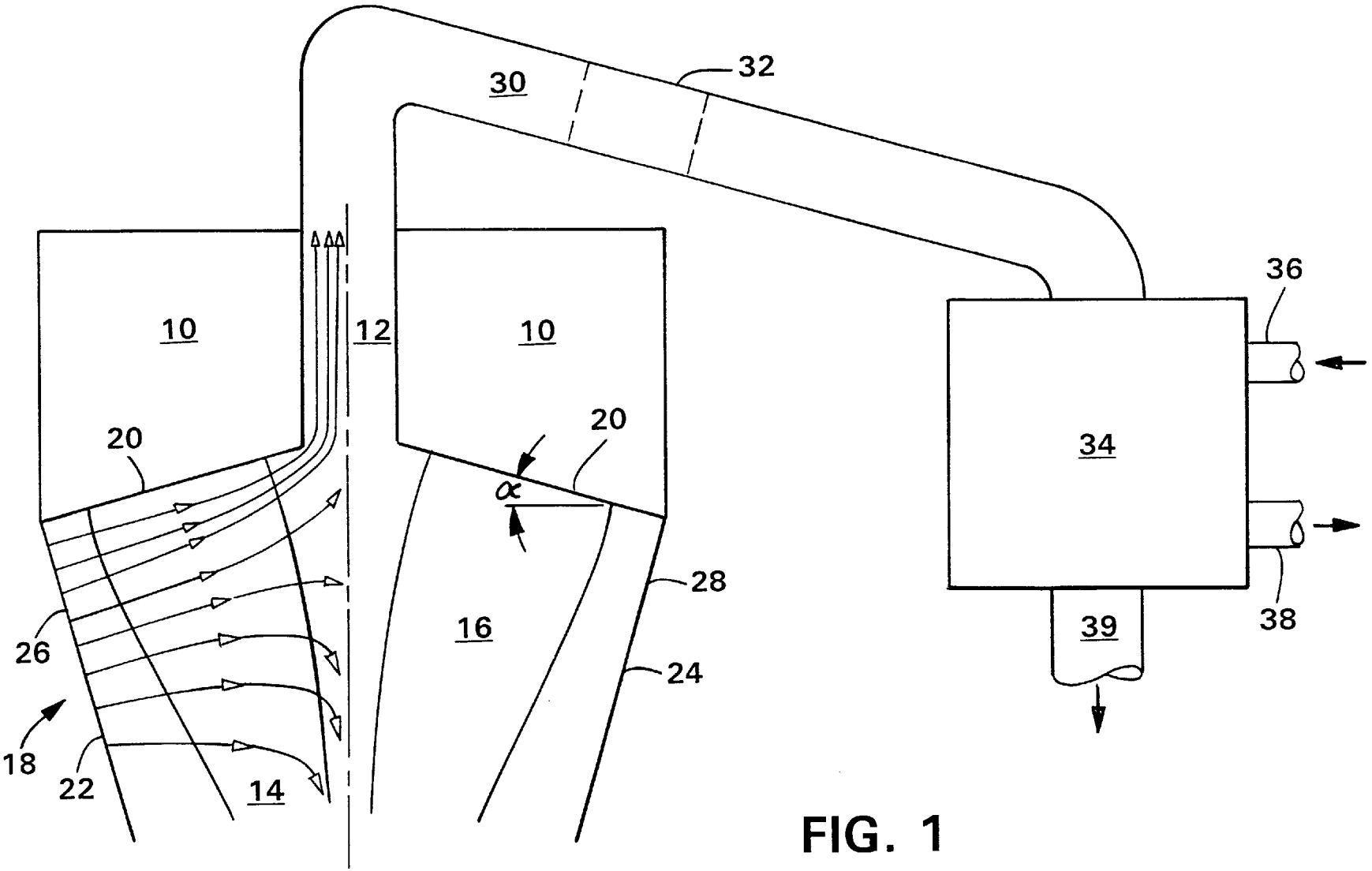
FIG. 1 is a schematic illustration of one embodiment of a multiple spinplate arrangement and process of the present invention showing a central conduit used for exhaust and means for removal of waxes and the like from the spinning process.

As used herein the term "nonwoven fabric or web" means a web having a structure of individual fibers or threads which are interlaid, but not in a regular or identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein the term "microfibers" means small diameter fibers having an average diameter not greater than about 75 microns, for example, having an average diameter of from about 5 microns to about 50 microns, or more particularly, microfibers may have an average diameter of from about 10 microns to about 20 microns. Another frequently used expression of fiber diameter is denier, which is defined as grams per 9000 meters of a fiber and may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($15^2 \times 0.89 \times 0.00707 = 1.415$). Outside the United States the unit of measurement is more commonly the "tex", which is defined as the grams per kilometer of fiber. Tex may be calculated as denier/9.

As used herein the term "spunbonded fibers" refers to small diameter fibers which are formed by extruding molten thermoplastic material as filaments from a plurality of fine, usually circular, capillaries of a spinneret with the diameter of the extruded filaments then being rapidly reduced as, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,502,538 to Levy, and U.S. Pat. No. 3,542,615 to Dobo et al., each of which is incorporated herein in its entirety by reference. Spunbond fibers are generally not tacky when they are deposited onto a collecting surface. Spunbond fibers are quenched and generally continuous and have average diameters larger than about 7 microns, more particularly, between about 10 and 20 microns.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and random symmetries.

As used herein the term "monocomponent" fiber refers to a fiber formed from one or more extruders using only one polymer. This is not meant to exclude fibers formed from one polymer to which small amounts of additives have been added for color, anti-static properties, lubrication, hydrophilicity, etc. These additives, e.g. titanium dioxide for color, are generally present in an amount less than 5 weight percent and more typically about 2 weight percent.

As used herein the term "conjugate fibers" refers to fibers which have been formed from at least two polymers extruded from separate extruders but spun together to form one fiber. Conjugate fibers are also sometimes referred to as multicomponent or bicomponent fibers. The polymers are usually different from each other though conjugate fibers may be monocomponent fibers. The polymers are arranged in substantially constantly positioned distinct zones across the cross-section of the conjugate fibers and extend continuously along the length of the conjugate fibers. The configuration of such a conjugate fiber may be, for example, a sheath/core arrangement wherein one polymer is surrounded by another or may be a side by side arrangement or an "islands-in-the-sea" arrangement. Conjugate fibers are taught in U.S. Pat. No. 5,108,820 to Kaneko et al., U.S. Pat. No. 5,336,552 to Strack et al., and U.S. Pat. No. 5,382,400 to Pike et al., each of which is incorporated herein in its entirety by reference. For two component fibers, the polymers may be present in ratios of 75/25, 50/50, 25/75 or any other desired ratios.

As used herein the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Biconstituent fibers are sometimes also referred to as multiconstituent fibers. Fibers of this general type are discussed in, for example, U.S. Pat. No. 5,108,827 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

As used herein the term "blend" as applied to polymers, means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein "thermal point bonding" involves passing a fabric or web of fibers to be bonded between a heated calender roll and an anvil roll. The calender roll is usually, though not always, patterned in some way so that the entire fabric is not bonded across its entire surface. As a result, various patterns for calender rolls have been developed for functional as well as aesthetic reasons. One example of a pattern has points and is the Hansen Pennings or "H&P" pattern with about a 30% bond area with about 200 bonds/square inch as taught in U.S. Pat. No. 3,855,046 to Hansen and Pennings which is incorporated herein in its entirety by reference. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen and Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds and a wire weave pattern looking as the name suggests, e.g. like a window screen. Typically, the percent bonding area varies from around 10% to around 30% of the area of the fabric laminate web. As is well known in the art, the spot bonding holds the laminate layers together as well as imparts integrity to each individual layer by bonding filaments and/or fibers within each layer.

As used herein, the term "personal care product" means diapers, training pants, absorbent underpants, adult incontinence products, and feminine hygiene products.

As used herein, the term "bundle" used with respect to fibers or filaments refers to a collection of fibers or filaments into a group or array which may take the form of a generally linear curtain or rectangular grouping or other configuration such as a tow or the like.

Test Methods

Fiber Tenacity test: fiber tenacity is determined by dividing breaking load in grams by denier and is a measure of the strength of a fiber per cross sectional area. Tenacity is an important measurement of the suitability of a fiber for many applications subject to stress and/or other strength requirements. Breaking load is determined in accordance with ASTM D3822 (Modified) using a Syntech Tensile Tester, available from Syntech, Inc. of Stoughton, Mass., and measures the maximum strength of a fiber when subjected to a constant rate of extension. A two-inch long fiber specimen is clamped within the tester leaving a one inch separation between the clamps. The clamps are separated at a rate of 12 inches per minute and the load or maximum force expressed in grams at the breaking point is measured as the breaking load.

Description

It is also possible to have other materials blended with the polymer used to produce a nonwoven according to this invention like fluorocarbon chemicals to enhance chemical repellency which may be, for example, any of those taught in U.S. Pat. No. 5,178,931, fire retardants for increased resistance to fire and/or pigments to give each layer the same or distinct colors. Fire retardants and pigments for spunbond and meltblown thermoplastic polymers are known in the art and are internal additives. A pigment, if used, is generally present in an amount less than 5 weight percent of the layer while other materials may be present in a cumulative amount less than 25 weight percent.

The fabric of this invention may be used in a multilayer laminate. An example of a multilayer laminate is an embodiment wherein some of the layers are spunbond and some meltblown such as a spunbond/meltblown/spunbond (SMS) laminate as disclosed in U.S. Pat. No. 4,041,203 to Brock et al., U.S. Pat. No. 5,169,706 to Collier, et al., and U.S. Pat. No. 4,374,888 to Bornslaeger. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 to 12 osy (6 to 400 gsm), or more particularly from about 0.75 to about 3 osy.

Spunbond nonwoven fabrics are generally bonded in some manner as they are produced in order to give them sufficient structural integrity to withstand the rigors of further processing into a finished product. Bonding can be accomplished in a number of ways such as hydroentanglement, needling, ultrasonic bonding, adhesive bonding, stitchbonding, through-air bonding and thermal bonding.

Referring to FIG. 1, one embodiment of the invention will be described. As shown, spinpacks 10, which may be but are not necessarily identical, are separated by duct 12. As those skilled in the art will appreciate, spinpacks 10 may be fed the same or different polymer compositions. In the latter case a layered structure may be obtained with the properties of the respective layers varying depending on the polymer and/or additives used in each. Fiber bundles 14, 16 exit the spinpacks into quench zone 18. Advantageously, the bottom surfaces 20 of spinpacks 10 form an angle, $\alpha$, with the horizontal or otherwise with respect to a line drawn orthogonally to the centerline of the central conduit to assist in directing the hot exhaust fluid (air) which has passed through the fiber bundles 14, 16 upward to the duct 12. This angle may be, for example, within the range of from a slight angle of about 1° to about 25° and especially within the range of from about 1° to about 10°. Likewise, sides 22,24 of the quench zone advantageously are formed at a slight angle of about 1° to about 20°, advantageously about 1° to about 10°, inward to assist in directing air and to maintain a relative constant distance between the quench air and the fiber bundle for more uniform quench. Quench air is admitted from both sides from ducts 26, 28 in a direction parallel to or nearly parallel to the spinplate although the flow pattern is shown only on one side for clarity. As shown, a portion of the quench air is exhausted upward through duct 12 while the rest is drawn to the fiber draw unit along with the fiber bundles. The temperature of the quench air is controlled to obtain the desired fiber properties. For example, for polypropylene spunbond web formation, quench air is advantageously in the range of from about 5° C. to about 25° C. As shown, the arrangement of the invention provides the advantages of multibank production in a single configuration and allows use of a single central fluid flow for both bundles. If desired, a fan assist may be provided to help remove fume laden air through the top. Also, depending on the need for increased flow stability, it may be desirable to provide an equalization slot between the spinplate surface and the quench duct, for example, of a width of about 1 inch to about 3 inches.

FIG. 1 also illustrates in schematic form an advantageous means to insure that residues such as condensed oil or wax flow away from the spunbond system which is of use particularly in some applications of high and moderate hole densities. As shown, spinpacks 10 are separated by duct 12 which is connected to duct 30 that is oriented at a downward angle to draw any condensates. Either or both ducts 12 and 30 may be insulated so as to minimize heat loss in the spinpacks. This duct may be rectangular exiting the spunbond machine and reformed to a circle or the like at collar 32. Duct 30 leads to condenser 34 which may be cooled by cooling water or the like through pipes 36, 38. The dewaxed air is then withdrawn such as by a fan through conduit 39. If needed, means conventionally used for such purposes may be used to draw the condensates (waxes) away from the spunbond system and through the condenser. For very high hole densities, other means for fume exhaust may be needed.

Figure 2:
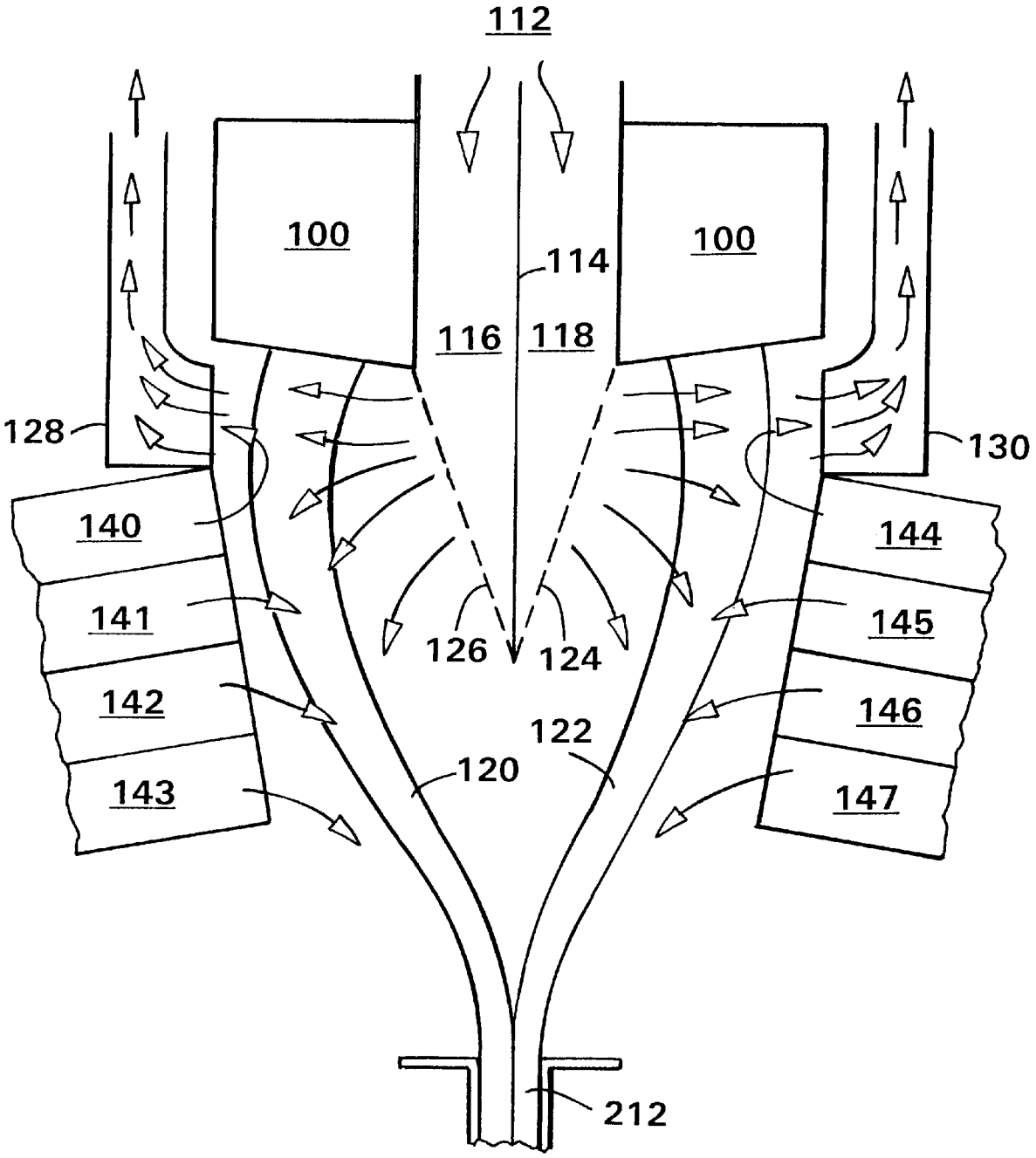
FIG. 2 is a schematic illustration of a different embodiment of a multiple spinplate arrangement and process of the present invention showing a central conduit used for two zone quench air supply.

FIG. 2 is a similar representation of a second embodiment where the quench air is brought into the middle and exhaust flows outward through the sides. As shown, spinpacks 100 are arranged on opposite sides of conduit or duct 112. Quench air may be supplied downward between the spinplates 100 in a single stream (or zone), pressurizing the airspace between the filament bundles 120, 122 so as to allow air to be drawn outward through each filament bundle. In this embodiment duct 112 may advantageously be divided by divider 114 into supply zones 116, 118 which direct quench fluid through bundles 120, 122 respectively. At very high hole densities and high central air flow, any interaction of the flow from the sides is minimized. Perforated plates or screens 124,126 may be provided to control the fluid flow and increase its uniformity. If used, these plates may advantageously have a graduated open area to further control the fluid flow. In this embodiment fume exhaust ducts 128, 130 are disposed on the opposite sides of bundles 120, 122 to receive a portion of the quench fluid. The rest of the quench fluid is drawn toward the filament bundles and carries or is carried by them toward the fiber draw zone 148 in much the same manner as in FIG. 1. This arrangement provides the advantages of the arrangement of FIG. 1 and, in addition, may permit control of quench fluid applied to the separate bundles. An added advantage is that any smoke may be kept warm until it reaches a desired location to deposit oils.

Figure 3:
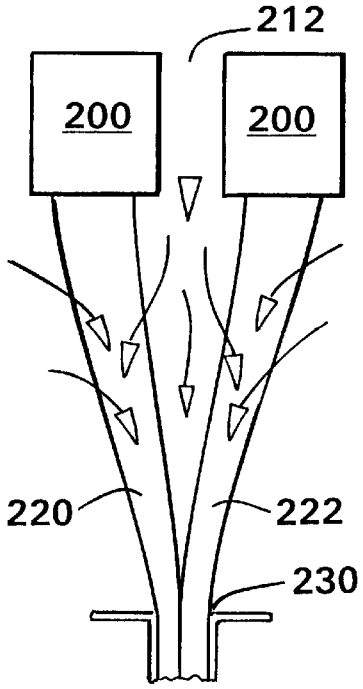
FIG. 3 is a schematic side view of a further embodiment of the type shown in FIG. 2 illustrating operation in the aspirating mode.
Figure 4:
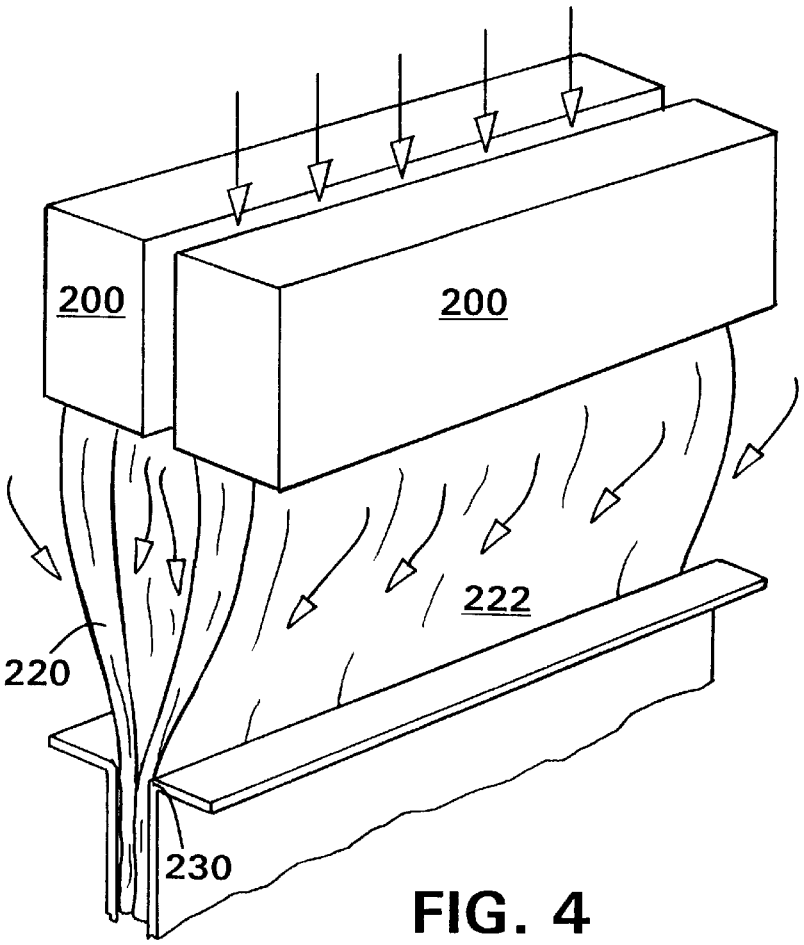
FIG. 4 is a perspective view of the type of embodiment shown in FIG. 3.
Figure 5:
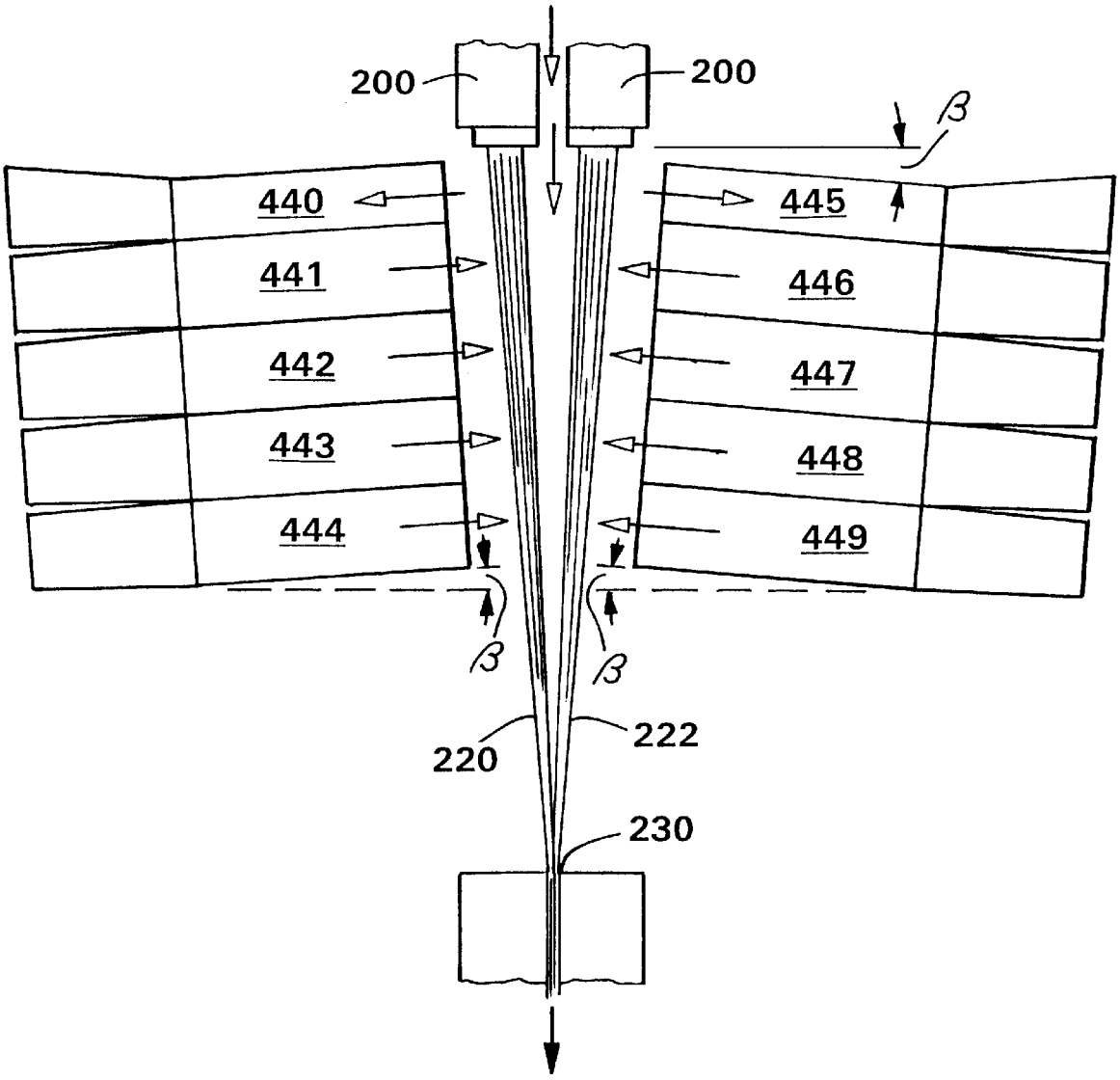
FIG. 5 is a view of an arrangement like that of FIG. 4 except that there are zones of quench air supply and the quench air is provided at a small angle to a line orthogonal to the central conduit.

FIG. 3 illustrates an embodiment operating in an aspirating mode where the vertical air stream drawn through conduit 212 aspirates quench air from the surroundings through the fiber bundles 220, 222 from spinpacks 200 to draw unit entry 230. In this arrangement increased holes per inch of die width have been demonstrated as well as higher throughput and better spinline stability. For example, spinning of at least 320 holes per inch is possible with reduced quench air requirements and reduced process control equipment requirements. Other variations will be apparent such as using a divided draw unit to maintain separation of the curtains to lay them down in a layered construction of the same or different fibers. FIG. 4 is a perspective view of the arrangement of FIG. 3. FIG. 5 shows an embodiment with quench air zones 441–444, 446–449 plus exhaust 440, 445 orientation at an angle "β" to horizontal or otherwise with respect to a line drawn orthogonally to the centerline of the central conduit. This angle may be within the range of from a slight angle of about 1° to about 25°, advantageously about 1° to about 15°, for example, and especially between about 1° and about 5° and may be obtained by, for example, by pivoting the spinplate or by shaping the spinplate surface. While the spacing between spin packs may be varied, it is contemplated that most operations will be with a spacing in the range of from a slight spacing of about less than an inch to about 20 inches and especially within the range of from about less than an inch to about 4.0 inches, advantageously up to about 1.5 inches. Other parameters of the arrangement will be generally within conventional ranges depending on the overall equipment configuration and desired operating conditions. For example, vertical quench air flow of from about 100 ft./min to about 1000 ft/min provides sufficient aspiration for a desirable level of heat transfer.

Figure 6:
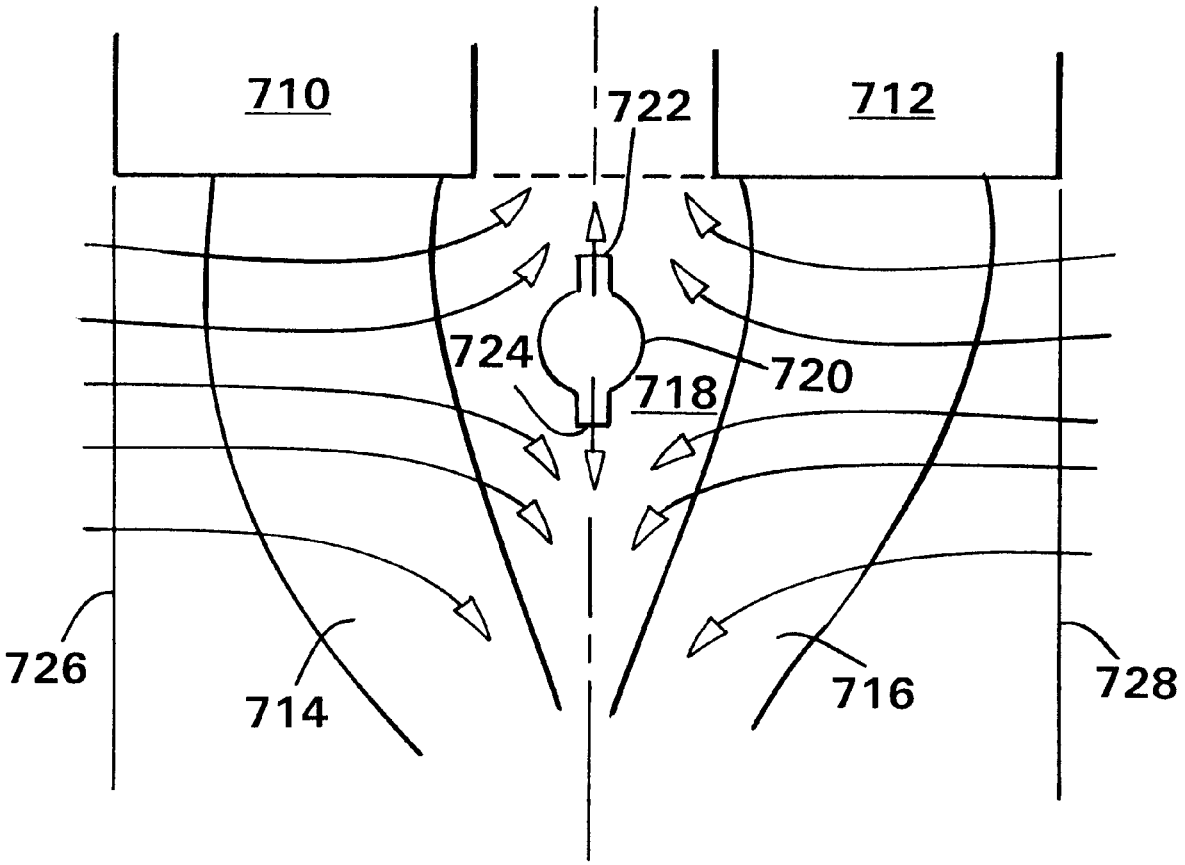
FIG. 6 is an illustration in schematic form of a split pack configuration with air flow in opposite directions along the centerline of the central conduit.

FIG. 6 illustrates in schematic form an arrangement which can be used with multiple spinplates or with a single spinplate having a portion blocked off or left open for fluid passage where no fibers are formed. Spinplate areas 710, 712 issue filament bundles 714, 716 separated by central conduit 718. Nozzle 720 connected to a quench fluid source directs quench upward and/or downward through apertures 722, 724. Quench air can be aspirated and/or blown in from sides 726, 728 through bundles 714, 716 as indicated. In this manner, a particularly economic system can be achieved by modification of an existing spinplate. Also, the relative flow in either direction may be easily controlled by selection of design parameters of the nozzle 720 and apertures 722, 724.

Figure 7:
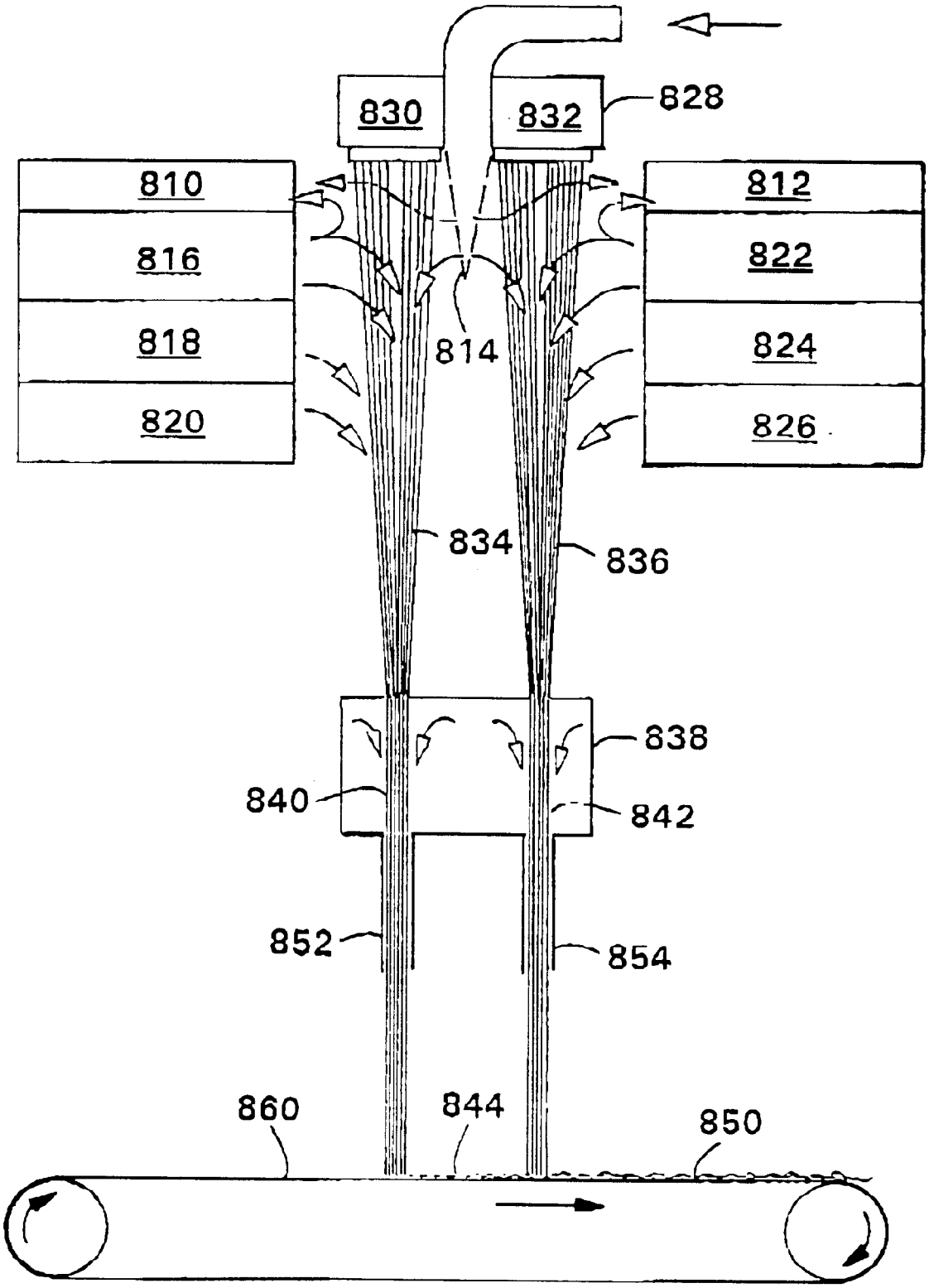
FIG. 7 is a view like that of FIG. 5 showing yet another embodiment providing additional flexibility for forming web structures and compositions.
Figure 8:
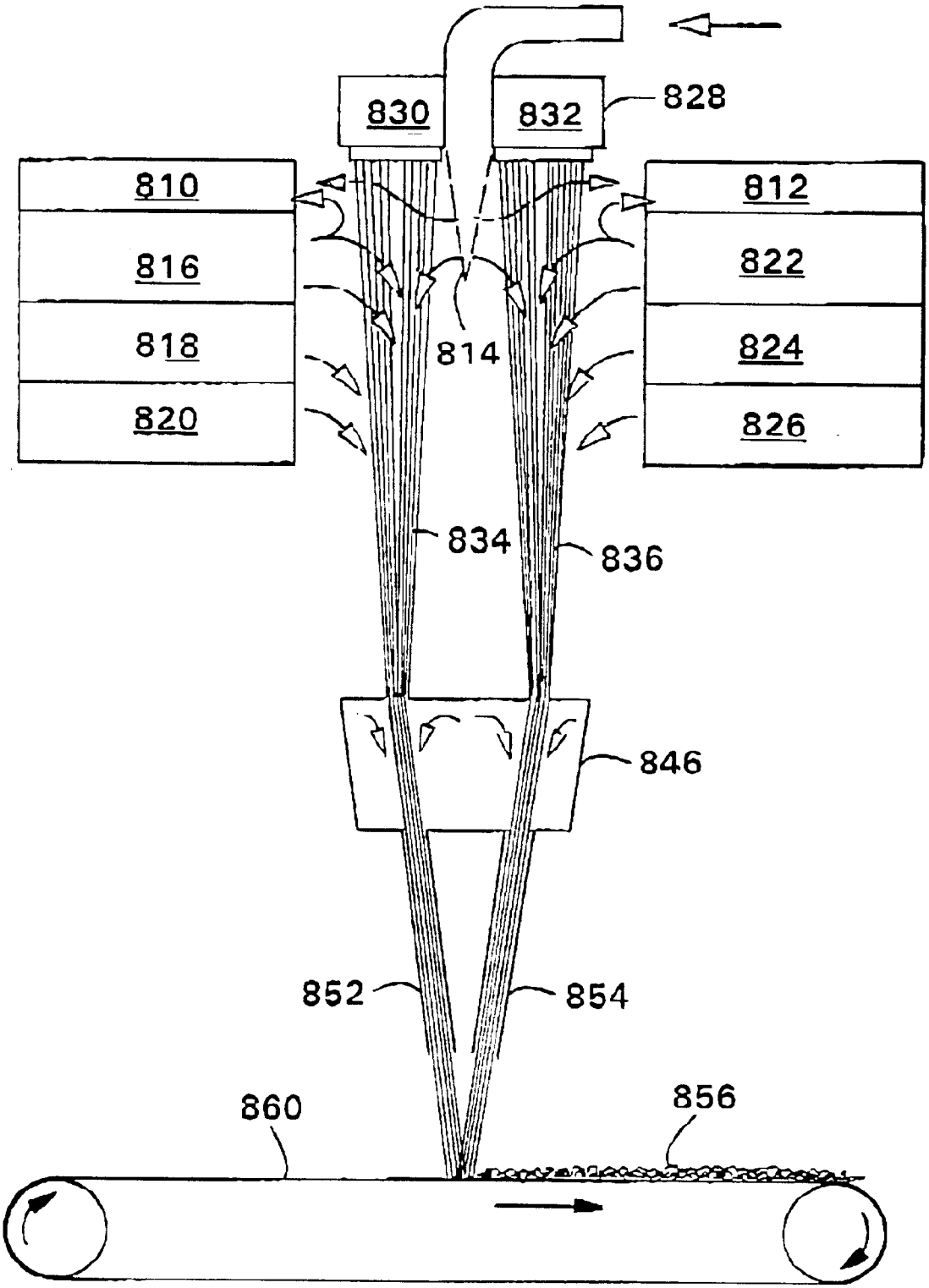
FIG. 8 is a view like that of FIG. 7 with the fiber exit modified to provide for fiber blending and attendant advantages.

FIG. 7 illustrates an embodiment like that of FIG. 5 except that the central quench means and fiber draw means are modified to add flexibility in forming different structures and compositions. In this case, fume exhaust boxes 810 and 812 receive a portion of the fluid from central quench box 814 as well as from side quench boxes 816, 818, 820, 822, 824, and 826. Split spin pack 828 includes packs 830 and 832 which may receive the same or different polymers from the same or separate sources and form separate filament bundles 834, 836. These bundles 834, 836 are directed to split draw unit 838 having a draw slot 840, 842 for each bundle. From the separate draw slots the filaments may be directed sequentially onto forming surface 844 either as web 850 of an accumulation of layers of the same type of filaments or, alternatively, different types of filaments may be deposited sequentially by choosing different spinning compositions for the spin packs 830, 832 or different spinning conditions which can produce different fiber properties such as crimp or tenacity, for example. As shown in FIG. 8, a web of mixed filaments may be formed by directing the draw unit 846 exits 852, 854 so that the exiting filaments mix prior to deposition on forming surface 860. All of the options described with respect to layers of filaments may be used to form mixtures of filaments. As will be also apparent to those skilled in the art, different treatments, additives, and filament shapes may also be used in the separate bundles. Also as will be apparent, more than two bundles may be formed that may be each the same or different in any of the ways described.

Conventional materials of construction may be used, and otherwise conventional spinplates may be employed in the arrangement of the invention. Also, the invention is applicable to multicomponent and biconstituent spunbond systems and includes any of the polymers processable to form spunbond webs. Any of the known bonding steps for spunbond webs such as thermal, adhesive, needling, hydroentangling and the like can be used in conjunction with the improvement of the present invention. In each case the invention results in higher efficiency and better control of fibers and web properties.

EXAMPLES

The invention will be described with reference to specific embodiments thereof. However, as will be recognized by those of skill in this art, these examples are merely illustrative, and the invention is not limited thereto. The invention is defined by the claims appended hereto and any equivalents as fall within the scope of the claimed subject matter.

Example 1

Equipment was assembled as generally illustrated in FIG. 4. In this case the spin plates were designed with rows of holes of 0.4 mm diameter at 320 holes per inch of spin plate width, and two rows were blocked for every three rows open for an operating condition of 192 holes per inch. The polymer used was polypropylene (Shell E5D47 from Union Carbide) with a melt flow rate of 34 and including 2% by weight of $TiO_2$ filler. The extruder was operated with seven temperature zones varying from about 350° F. to about 460° F. at the exit. The throughput was at a rate of about 0.5 grams per hole per minute (ghm), and the draw unit was operated at about 5 psi mainifold pressure. The forming surface was operated at a line speed of about 510 feet per minute (fpm) providing a basis weight of about 0.72 ounce per square yard (osy) with fiber denier of about 1.5. This web was bonded with a wire weave pattern using steel patterned rolls at temperatures of about 305° F. for the patterned roll and about 300° F. for the anvil roll. For this example the quench zones 1–4 varied in air velocity from about 170 feet per minute (fpm), 155 fpm, 145 fpm, to 140 fpm, and quench zones 5–8 varied in air velocity from about 180 fpm, 160 fpm, 145 fpm, to 140 fpm using quench air at a temperature set point of about 55° F. This set point was used throughout the examples. As will be recognized by those skilled in the art, because of the high temperature of the melt, the exact temperature of quench air is not critical and involves consideration of factors such as cost and quench capacity. The air flow through the central conduit was at a rate of 300 fpm of air at a temperature of about the same temperature. Exhaust was at a flow rate of 100 fpm.

Example 2

Example 1 was repeated with spin plates having only one row blocked for 3 open rows providing for 240 holes per inch of machine width. In this case the quench boxes were each oriented at an angle of about 4° from horizontal as shown in FIG. 5. The throughput was about 0.46 ghm at about 7 psi producing fibers of about 1.68 dpf. In this case quench zones 1–4 and 5–8 were operated at identically varying air flow rates of about 180 fpm, 180 fpm, 160 fpm, to 150 fpm, and the central air was at a velocity of about 400 fpm.

Example 3

Example 2 was repeated with no blocked rows for a hole density of 320 holes per inch. The bond pattern was varied to an EHP pattern of squares of 0.037 inch (0.94 mm) per side and 0.097 inch (2.464 mm) pin spacing for a percent bond area of about 15. Quench zones 1–4 were operated at air velocities of about 420 fpm, 195 fpm, 155 fpm, to 147 fpm, and zones 5–8 at about 526 fpm, 190 fpm, 160 fpm, to 147 fpm of, and the central air flow was at about 507 fpm. The angle of the quench boxes was changed from 4° to 3° from horizontal and no exhaust was provided. In this case a web of about 0.8 osy was made of fiber denier about 2.1. In this case it was found that within the ranges tried, improved results tended to be obtained with higher air flows from the sides with lower central air flows useful. Especially for these higher hole densities, side air flows of at least about 500 fpm are believed advantageous. As will be appreciated by those skilled in the art, as air flow is increased, a point will be reached where filament shearing occurs. In all cases of the invention, it was possible to exceed conventional maximum hole densities of about 184 holes per inch making possible finer fibers while maintaining desirable strength properties.

Fiber tenacity results on fibers made in accordance with the invention are generally in the range of results obtained with conventional processes and equipment. For example, fibers produced as in the foregoing examples had tenacity results in the range of from about 1.56 grams per denier to about 2.33 grams per denier compared with conventional similar composition fiber results of about 1.5 grams per denier to about 4.5 grams per denier. Thus, strong fibers are obtained in accordance with the invention even at those high hole densities.

Thus, in accordance with the invention, there has been provided an improved spunbond process, equipment and resulting treated nonwovens and products incorporating them that provide the benefits described above. While the invention has been illustrated by specific embodiments, it is not limited thereto and is intended to cover all equivalents as come within the broad scope of the claims.

We claim:

1. Apparatus for forming continuous filaments for forming nonwovens comprising:

a. one or more sources of filament forming material in a spinnable condition;

b. one or more spinplates, each adapted to receive said filament forming material;

c. means for directing said filament forming material through said spinplates forming a plurality of filament bundles;

d. a central conduit between said filament bundles; and e. means for directing a fluid through said central duct to contact said filaments; the improvement wherein said means a–e comprise an integral spinbank and at least one of said spinplates is oriented at an angle within the range of from about 1° to about 25° with respect to a line drawn orthogonally to the centerline of said central duct.

2. The apparatus of claim 1 wherein said fluid directing means provides fluid at a velocity within the range of at least about 500 fpm in the direction of said filament forming material and means are provided for aspirating fluid through said filaments along with said directed fluid.

3. The apparatus of claim 2 wherein said means for directing fluid comprises air directing means and said means for aspirating fluid comprises air aspirating means.

4. The apparatus of claim 1 wherein said fluid directing means comprises means for directing fluid through said filaments from opposing sides into said central conduit.

5. The apparatus of claim 4 wherein said opposed fluid directing means aspirate additional fluid through said central conduit.

6. The apparatus of claim 5 wherein said fluid directing means comprises air directing and air aspirating means.

7. The apparatus of claim 4 wherein said directing means comprises a plurality of zones adapted to provide fluid at different velocities.

8. The apparatus of claim 5 wherein said directing means comprises a plurality of zones adapted to provide fluid at different velocities.

9. The apparatus of claim 2 including exhaust means comprising means for removal of condensates and residues.

10. The apparatus of claim 7 wherein said directing means on opposing sides of said filaments are offset with respect to each other in the direction of said central conduit fluid flow.

11. The apparatus of claim 8 wherein said directing means on opposing sides of said filaments are offset with respect to each other in the direction of said central conduit fluid flow.

12. The apparatus of claim 4 wherein means are provided to reduce variation in distance between said fluid directing means and said filament bundles.

13. The apparatus of claim 1 wherein said angle is obtained by pivot means associated with said spinplates.

14. The apparatus of claim 1 wherein said angle is obtained by the shape of said spinplate.

15. A process for forming continuous filaments for forming nonwoven fabrics comprising the steps of:

a. providing a filament forming material in a spinnable condition;

b. extruding said filament forming material into filaments through one or more spinplates within an integral spinbank forming a plurality of filament bundles;

c. separating said bundles by a central conduit positioned so that at least one of said spinplates is oriented at an angle within the range of from about 1° to about 25° with respect to a line drawn orthogonally to the centerline of said central duct;

d. directing fluid through said central conduit in the direction of said filament extrusion and containing said filaments; and e. collecting said filaments.

16. The apparatus of claim 1 further including a draw zone comprising a plurality of draw slots, each of which receives at least one fiber bundle and draws such fibers and directs the drawn fibers to a forming surface.

17. The apparatus of claim 16 wherein said draw slots are disposed at an angle to cause mixing of said fiber bundles at or before reaching the forming surface.

18. The process of claim 15 including the step of drawing said bundles separately prior to collecting said filaments.

19. The process of claim 18 including the additional step of mixing said drawn bundles prior to collecting said filaments.

* * * * *